United States Patent [19]

Foster

[11] 4,414,904

[45] Nov. 15, 1983

[54] WASTE-BURNING FURNACE

[76] Inventor: Glenn M. Foster, Rte. 4, Box 559, Yadkinville, N.C. 27055

[21] Appl. No.: 326,714

[22] Filed: Dec. 2, 1981

[51] Int. Cl.[3] ..... F23K 3/00

[52] U.S. Cl. ..... 110/102; 110/108; 110/300; 432/500

[58] Field of Search ..... 110/102, 196, 108, 298, 110/299, 300, 323, 326; 432/500; 126/163 R, 168, 245

[56] References Cited

U.S. PATENT DOCUMENTS

| | | | |
|---|---|---|---|
| 178,372 | 6/1876 | Kidder | 110/298 |
| 228,405 | 6/1880 | Smith | 110/294 |
| 345,611 | 7/1886 | Ayres | 110/299 |
| 355,318 | 1/1887 | Howard | 110/299 |
| 359,034 | 3/1887 | Reno | 110/299 |
| 374,350 | 12/1887 | Dashiell | 110/299 |
| 403,830 | 5/1889 | Flood | 110/102 |
| 409,285 | 8/1889 | Hildreth | 110/300 |
| 411,379 | 9/1889 | Gordon | 110/300 |
| 421,288 | 2/1890 | Kennedy | 110/300 |
| 424,039 | 3/1890 | Turnbull et al. | 110/299 |
| 519,779 | 5/1894 | Thomas | 110/299 |
| 527,001 | 10/1894 | Koch | 110/300 |
| 558,185 | 4/1896 | Kridler | 110/300 |
| 574,030 | 12/1896 | Gordon | 110/300 |
| 685,444 | 10/1901 | Casey | 110/300 |
| 696,937 | 4/1902 | Burger et al. . | |
| 739,491 | 9/1903 | Grey | 110/300 |
| 826,122 | 7/1906 | Small | 110/300 |
| 915,852 | 3/1909 | Gordon | 110/300 |
| 949,402 | 2/1910 | Oliphant | 110/300 |
| 1,178,274 | 4/1916 | Simmons . | |
| 1,214,422 | 1/1917 | Brown et al. . | |
| 1,280,151 | 10/1918 | Brown | 126/168 |
| 1,538,761 | 5/1925 | Van Wagenen . | |
| 1,552,365 | 9/1925 | Voigt | 110/300 |
| 1,617,186 | 2/1927 | Van Wagenen . | |
| 1,832,223 | 11/1931 | Klopfenstein | 110/300 |
| 1,982,918 | 12/1934 | Marty | 110/74 |
| 2,408,969 | 10/1946 | Cross et al. | 122/4 |
| 2,479,526 | 8/1949 | Touton | 31/221 |
| 2,752,144 | 6/1956 | Oldenkamp et al. | 110/326 |
| 2,879,727 | 3/1959 | Walters | 110/29 |
| 3,664,034 | 5/1972 | Wilson | 34/225 |
| 3,995,568 | 12/1976 | Dvirka et al. | 110/8 R |
| 4,007,696 | 2/1977 | Robertson | 110/31 |
| 4,102,279 | 7/1978 | Groschl et al. | 110/234 |
| 4,156,394 | 5/1979 | Mallek et al. | 110/346 |
| 4,180,052 | 12/1979 | Henderson | 126/108 |
| 4,184,437 | 1/1980 | Mallek et al. | 110/251 |
| 4,254,715 | 3/1981 | LaHaye et al. | 110/300 |
| 4,312,278 | 1/1982 | Smith et al. | 110/102 |

*Primary Examiner*—Edward G. Favors
*Assistant Examiner*—Steven E. Warner

[57] ABSTRACT

The furnace includes an upstanding hopper-like member having an increasing cross-sectional area from a fuel inlet at its upper end to a hollow box-like grate releasably and removably mounted within its lower end portion at an elevation slightly below the upper extremity of a gas passageway opening laterally from such member and communicating with a manifold chamber extending horizontally therefrom. The grate has elongate slot-like openings extending horizontally of and vertically through its medial portion, and preferably includes cylindrical solid rods extending longitudinally of the upper portions of such openings. An electrically-powered blower is releasably connected to the grate, for movement therewith, and during operation conducts air to the interior of the hollow sections of the grate. The latter are provided with apertures which discharge jets of air vertically upwardly and downwardly, and also angularly upwardly and downwardly, from the grate. The angularly directed air jets include ones that emanate from the upper edges of the grate openings and are directed toward the centers of such openings, and others that are discharged from grate edges that are closely adjacent the gas passageway and are directed toward such passageway. Normally shut closure members are provided in association with the fuel inlet at the upper end of the hopper-like member and in association with an ash-removal passageway provided within the lower end portion of such member. Gaseous combustion products introduced into the manifold chamber pass therefrom through ducts communicating therewith on opposite sides of a vertical baffle extending centrally and longitudinally of the chamber.

9 Claims, 7 Drawing Figures

WASTE-BURNING FURNACE

BACKGROUND OF THE INVENTION

This invention relates to furnaces capable of effectively utilizing sawdust and similar low-cost "waste" materials as fuel. The invention more specifically relates to a waste-burning furnace that, although capable of other uses, is particularly adapted for the heating of tobacco curing and drying barns.

Many tobacco barns heretofore have been heated by oil-fired furnaces. Due to the increasing price of fuel oil, however, there now is an acute need for an alternative and more economical means for heating tobacco barns. One such alternative means is a furnace fueled by sawdust and similar "waste" material, such as wood chips, vegetable stalks and the like, that usually may be procured in rural environments at little or no cost. If such a furnace is to be commercially acceptable, however, it must not only be capable of efficiently burning waste material of the foregoing type, but must also satisfy other requirements. It should be relatively inexpensive to purchase and install, bearing in mind that a typical tobacco grower may have several tobacco barns, each requiring heating during only a relatively brief part of each year. The furnace should also be capable of automatic operation with only minimal operator-attention. A furnace requiring too-frequent operator attention for re-fueling, ash removal and/or proper temperature maintenance (which is critical to the drying and curing of tobacco) would be unacceptable. Additionally, the furnace should be exceedingly durable and easy to maintain and repair, since any prolonged interruption of its operation during the heating of a tobacco barn could detrimentally affect the tobacco's quality.

DESCRIPTION OF THE PRIOR ART

Waste-fuel furnaces or burners are disclosed in U.S. Pat. Nos. 4,254,715, 4,102,279, 4,007,696, 2,879,727, 1,832,223, 915,852, 527,001, 421,288, 409,285, 228,405 and 178,372. The furnaces of Patent Nos. 4,254,715, 409,285, 915,852, 527,001 and 421,288 include hollow perforate grate members to which blowers are connected. The furnace of U.S. Pat. No. 288,405 includes a fuel chamber that along part of its height is of downwardly increasing cross-sectional area.

Additional disclosures of furnaces having hollow perforate grate members connected to blowers are found in U.S. Pat. Nos. 1,982,918, 949,402, 739,491, 685,444, 574,030, 558,185, 411,379, 374,350 and 359,034.

SUMMARY OF THE INVENTION

The present invention provides a waste-burning furnace that, although capable of other utilizations, is particularly adapted and useful for the heating of tobacco barns in that, in addition to being capable of highly efficient operation with sawdust or similar waste-type fuel, the furnace can be economically purchased, installed and maintained, is durable and easily repairable when required, and requires only minimal operator attention.

In a preferred embodiment thereof, the furnace of the present invention includes an upstanding hopper-like member having a fuel inlet adjacent and preferably at its upper end, and a gas outlet passageway opening laterally from its lower end portion. Mounted within the aforesaid member at an elevation slightly below the top of the gas passageway is a hollow box-like grate member having elongate slot-like openings extending horizontally of and vertically through its medial portion. The interior of hopper-like member is smooth-surfaced and has a cross-sectional area that increases in size from the fuel inlet to the grate, to facilitate gravity descent of fuel from the former to the latter. An elongate manifold chamber extends horizontally outwardly from that lower portion of the hopper-like member containing the gas outlet passageway, and receives gaseous products of combustion passing thereto from the hopper-like member and through such passageway. The heated combustion gases introduced into the chamber exit therefrom through duct means preferably consisting of at least two duct members communicating with the chamber on opposite sides of a vertical baffle member provided within and extending longitudinally of the chamber. The hollow box-like grate is connected to an electrically powered blower and apertures provided within the grate surfaces are effective during operation of the blower to discharge jets of air vertically upwardly, vertically downwardly, angularly upwardly and angularly downwardly from the grate. Some of the angularly directed jets are directed above the grate openings from the opposite upper edges thereof, while others of such jets are directed toward the gas passageway of the hopper-like member, and still others are directed toward areas beneath the grate where particles of unburned fuel might otherwise tend to accumulate.

The grate preferably further includes elongate cylindrical rod-like members mounted centrally of the grate openings and extending longitudinally thereof.

Preferably the grate and blower are releasably connected together for movement as a unit out of association with the hopper member for purposes of convenient repair or replacement when required, and/or to permit storage of such unit when the furnace is not in use.

DESCRIPTION OF THE DRAWINGS

Other features of the invention will be apparent from the following description of a preferred embodiment thereof, which should be read in conjunction with the accompanying drawings, in which.

DESCRIPTION OF THE PREFERRED EMBODIMENTS

Figure 1:
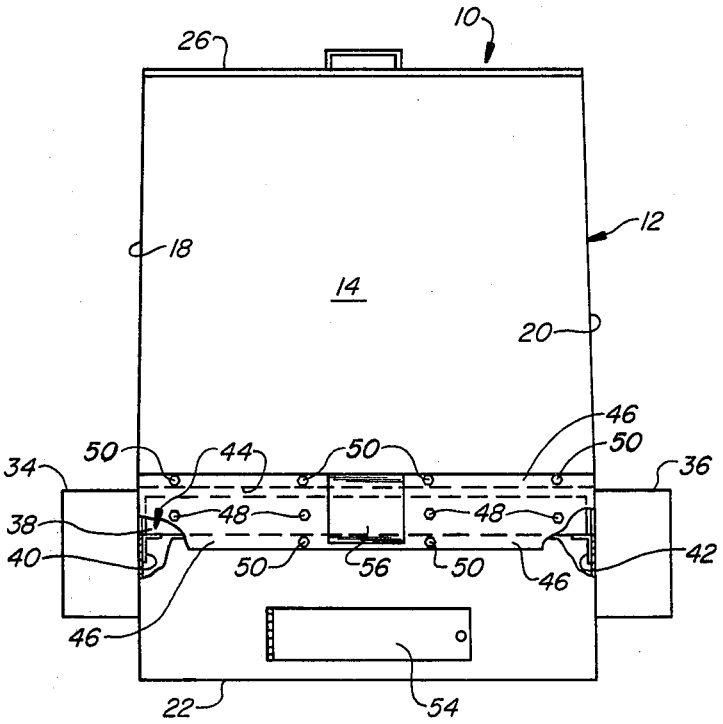
FIG. 1 is a front elevational view, partially broken away to disclose interior details, of a waste-burning furnace in accordance with the invention.
Figure 2:
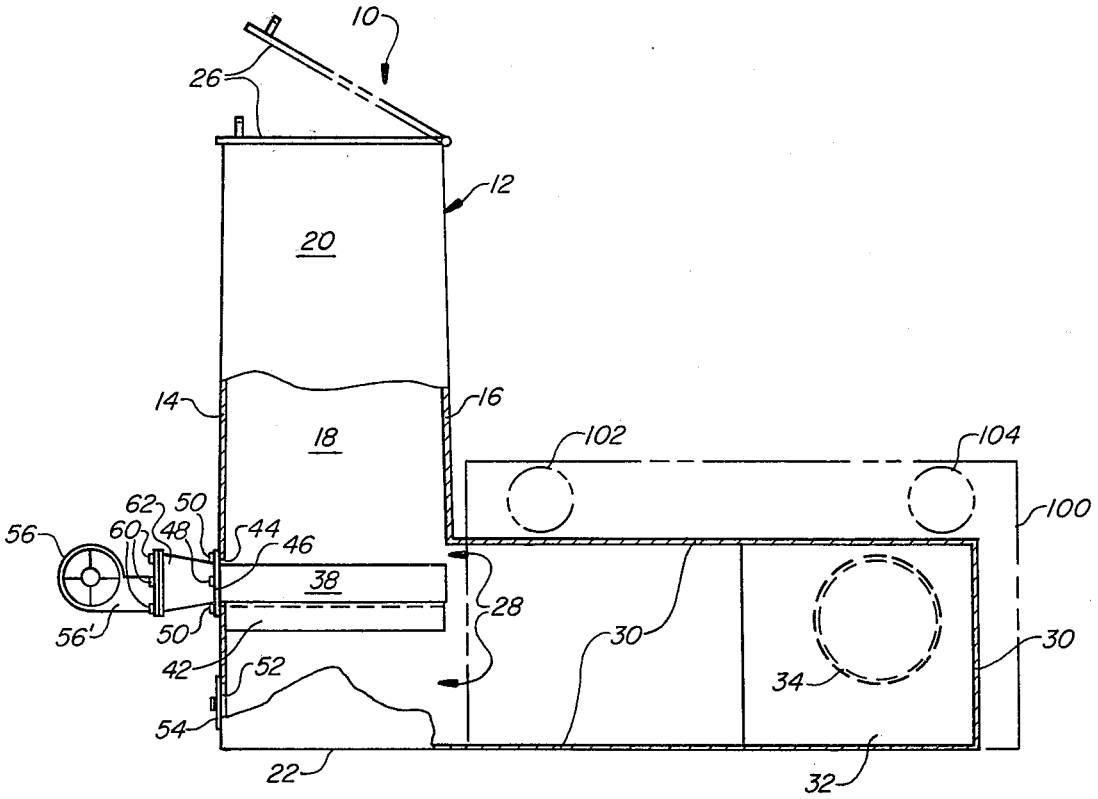
FIG. 2 is a partially broken away side elevational view of the furnace.
Figure 3:
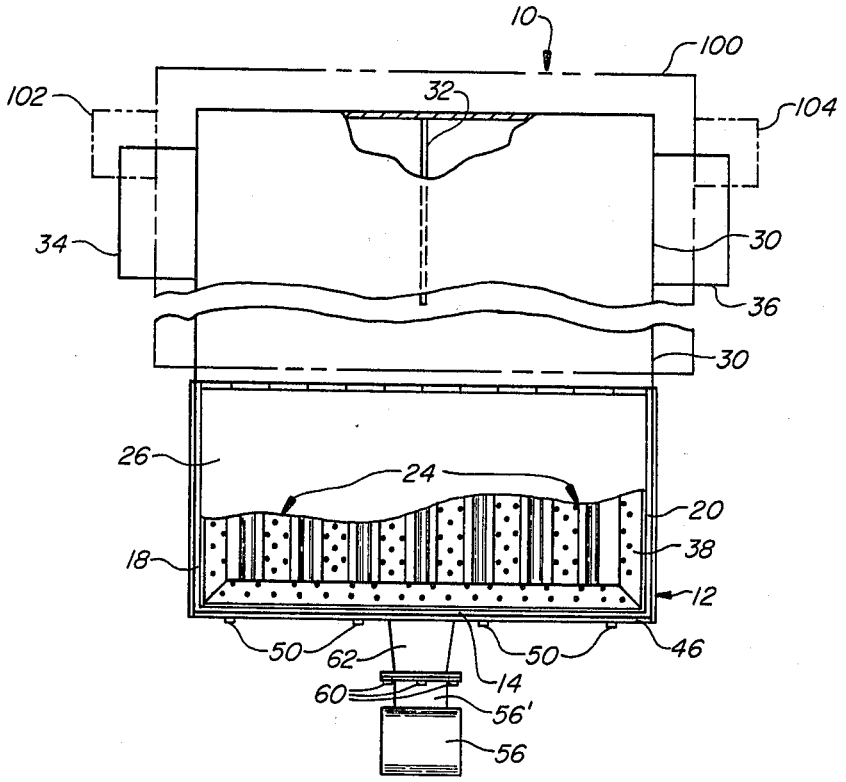
FIG. 3 is a partially broken away and foreshortened top plan view of the furnace.

Referring more particularly to the drawings, the furnace designated in its entirety in FIGS. 1–3 by 10 includes an upstanding hopper-like member 12 formed of rigid heat-resistant metal and having a continuous front wall 14, rear wall 16, side walls 18,20 and a bottom 22. The open upper end of member 12 defines an inlet 24 through which sawdust and similar waste-type fuel is introduced when an associated and normally closed lid 26, pivotally connected to the upper edge of rear wall 16 of member 12, is open. A passageway 28 for gaseous products of combustion opens laterally from the lower portion of member 12, and more specifically is provided within the lower portion of its rear wall 16. Gaseous combustion products exiting from member 12 through passageway 28 enter the open forward end of an elongate manifold chamber 30 extending rearwardly from outlet 28 and the lower portion of member 12 and connected to or, as shown, formed integrally with the latter. A vertical baffle member 32 within chamber 30 spans its entire height and extends along approximately the rearward one-half of its length. Heated combustion gases introduced into manifold chamber 30 through passageway 28 of member 12 exit from the chamber through ducts 34,36 communicating with upper rearward portions of the opposite side walls of chamber 30. The presence of baffle 32 within chamber 30 assists in more nearly equalizing the flows of heated combustion gases conducted from the chamber by the respective ducts 34,36.

A hollow box-like grate member 38 is releasably and removably mounted within the lower portion of hopper-like member 12 at an elevation space slightly below the upper extremity of gas passageway 28 of member 12. More specifically, the distance between the horizontal plane of the upper surface of grate 38 and the horizontal plane of the upper edge of outlet 28 is preferably only approximately 1.5 inches. The means by which grate 38 is releasably and removably mounted includes angle members 40,42 that underlie and support opposite side edges of grate 38 and that are permanently affixed to respective opposite side walls 18,20 of hopper-like member 12. The horizontal plane of the upper grate-supporting surfaces of angle members 40,42 intersects front wall 14 of hopper-like member 12 at or slightly above the lower edge of a grate passageway 44 opening through wall 14. A cover plate 46 which is releasably secured to the front surface of grate 38 by bolts 48, and which is also releasably secured to front wall 14 of hopper-like member 12 by other bolts 50, overlies and closes grate passageway 44 when grate 38 is fully received within hopper-like member 12. Removal of grate 38 from member 12 may be readily accomplished when desired simply by loosening bolts 50 and then sliding grate 38 forwardly along angle members 40, 42 through passageway 44. Reinsertion of grate 38 within member 12 is accomplished with equal facility by a reversal of the foregoing procedure.

During use of furnace 10, the section of hopper-like member 12 below its fuel inlet 24 and above grate 38 is filled with sawdust and/or other waste-type fuel (not shown). Combustion of the fuel charge within the aforesaid section of hopper-like member 12 occurs, as described in greater detail hereinafter, at or closely adjacent the upper portion of grate 38. As the lowermost portion of the fuel within the aforesaid section of member 12 is consumed by the combustion process, the remaining portion of such fuel is adapted to descend downwardly by gravity toward grate 38 while ashes, and any particles of fuel not totally combusted at or above grate 38, are received within the lower portion of member 12 below grate 38 and above bottom 22 of member 12. To insure the aforesaid gravity descent of the remaining fuel within the hopper section of member 12, the interior of such section is smooth-surfaced and its cross-sectional area increases throughout the entire height thereof from inlet 24 to grate 38. More specifically in the foregoing regard, in at least in the aforesaid upper section of member 12 each of its upstanding walls 14,16,18,20 is inclined somewhat relative to the vertical such that it is horizontally displaced further from the center of member 12 at the elevation of grate 38 than at the elevation of fuel inlet 24. The preferred magnitude of each wall's slope is approximately 0.25 inches per foot. To facilitate periodic removal of accmulated ashes from that lower portion of member 12 beneath grate 38, an ash-removal opening 52 and associated pivotal door 54 are provided in association with the lower section of front wall 14 of member 12.

An electrically-powered blower 56, which is actuable either manually or by means of a temperature-responsive switch 58 (FIG. 7) has its outlet 56' releasably secured by bolts 60 to the forward end of a conduit 62 communicating with the interior of hollow grate 38 and projecting forwardly therefrom through a suitable opening (not shown) provided within cover plate 46. While blower 56 may be readily removed from grate 38 if such should be necessary or desired, simply by loosening bolts 60, it will be apparent that the blower and grate normally constitute a single unit that may if desired be completely removed from association with furnace 10, as for instance during periods of time when the furnace is not to be in service, simply by disconnecting the blower's electrical power supply line or cord (not shown), loosening bolts 50, and then moving the entire unit forwardly.

Figure 4:
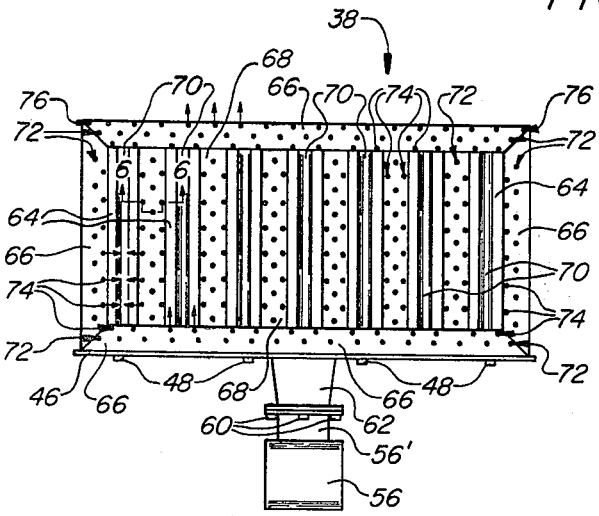
FIGS. 4 and 5 are respectively top and bottom plan views of the grate and blower unit of the furnace.
Figure 5:
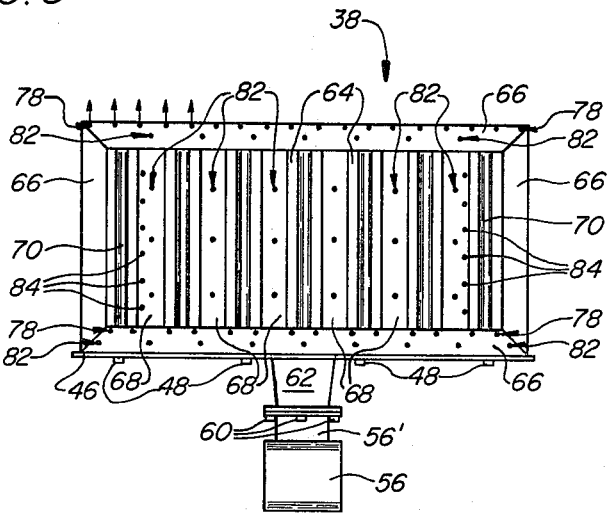
Figure 6:
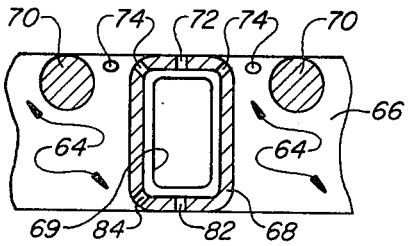
FIG. 6 is an enlarged vertical section taken substantially along the line 6--6 of FIG. 4 through a portion of the furnace grate.

Referring now also to FIGS. 4–6 of the drawings, grate 38 has a plurality (illustratively and preferably seven) elongate and parallel slot-like openings 64 extending forwardly-rearwardly of and vertically completely through its medial or central portion. Openings 64 permit passage of ash vertically downwardly through grate 38, and do not communicate with the hollow grate sections into and through which air is conducted by blower 56. The aforesaid hollow grate sections include a continuous border section 66 extending about the entire periphery of the grate, and a plurality (illustratively six) of therewith coplanar medial sections 68 which extend in alternating parallel relationship to openings 64 between the forward and rearward members of border section 66. The opposite ends of each medial section 68 are rigidly affixed to border section 66 and communicate therewith via openings 69, one of which is shown in FIG. 6, provided within section 66. Grate 38 further includes a plurality of solid steel rods 70, of cylindrical cross-sectional shape, whose upper surfaces are substantially coplanar with the upper surfaces of grate sections 66,68. Each rod 70 is laterally centered within a corresponding one of the openings 64 and its opposite ends are welded or otherwise rigidly affixed to the front and rear members of border section 66. In addition to strengthening grate 38, rods 70 restrict the effective size of openings 64 and discourage the passage of uncombusted fuel through grate openings 64 during operation of furnace 10.

Although capable of being constructed of other materials and in other ways, grate sections 66,68 may be and preferably are formed from hollow steel tubing of the substantially rectangular cross-sectional shape shown in FIG. 6. In addition to permitting economical fabrication of a grate 38 posssessing the necessary considerable strength and interior volume, tubing of the type shown in FIG. 6 has arcuate edges that facilitate the entry of ashes into grate openings 64 and also facilitate the formation, by drilling, of edge-located ones of numerous air-jet discharging apertures with which grate 38 is provided.

In the latter connection, and as best shown in FIG. 4, vertical apertures of approximately three-sixteenths of an inch in diameter are provided within and centrally of the upper surfaces of grate sections 66,68 at spaced intervals of approximately two inches along the entire lengths of such sections. During operation of blower 56, apertures 72 discharge jets of air vertically upwardly from grate 38, into the undersurface of the fuel within hopper-like member 10. Additional apertures 74 of the same size are provided within and at spaced intervals along the lengths of those upper edge portions of grate sections 66,68 immediately adjacent grate openings 64. The apertures 74 adjacent each opening 64 discharge jets of air angularly upwardly at an angle of approximately 45° from all sides of and toward the center of such opening, thereby assuring that fuel immediately thereabove is particularly well supplied with combustion air. Other apertures 76 are spaced at approximately two inch intervals along the entire length of the rearmost upper edge of grate 38, which grate edge is closely adjacent gas passageway 28 of hopper-like member 12. When blower 56 is operating, apertures 76 discharge jets of air angularly upwardly and rearwardly from grate 38 into passageway 28, inducing a draft through passageway 28 into manifold chamber 30 and also supplying additional combustion air to complete the final combustion of any particles of fuel that might pass into chamber 30 along with the heated gaseous combustion products.

As is best shown in FIG. 5 of the drawings, aperture means are also provided within the undersurface of grate 38. Apertures 78 are spaced at approximately two inch intervals along the entire lengths of the rearmost lower edges of both the forward and rearward tubular members of border section 66 of grate 38. Apertures 78 discharge jets of air angularly downwardly and rearwardly during of operation of blower 56, to assist the air jets discharged from previously-discussed apertures 76 in inducing a draft through passageway 28 and in insuring final combustion of any incompletely burned particles of fuel that might be within their paths. Other apertures 82 are provided at longitudinally spaced and laterally centered intervals along the entire lengths of the front and rear tubular members of grate border section 66 and of medial grate sections 68. These apertures discharge jets of air vertically downwardly from the aforesaid grate sections into the ashes (not shown) passed downwardly through grate openings 64 during operation of furnace 10, for the purpose of insuring final combustion of any incompletely burned particles of fuel that might be present in the ashes. Apertures 82 are smaller in total number and are spaced further from each other, at approximately four inch intervals, then the corresponding vertical apertures 72 within the upper surface of grate 38 and adjacent to which combustion of the fuel primarily occurs. No apertures are provided within the under surfaces of the forwardly-rearwardly extending tubular members defining opposite lateral sides of border section 66 of grate 38 since, during use of furnace 10, such tubular members are underlaid by respective ones of the grate-supporting angle members 40,42 (FIGS. 1 and 2). However, apertures 84 are provided within and along the length of the lower outer edges of the two outermost medial grate sections 68 for directing jets of combustion air angularly outwardly and downwardly into the areas beneath angle members 40,42.

It will be appreciated that, during operation of furnace 10, the ambient air forced into the hollow interior of grate 38 by blower 56 is heated during its passage through the grate's interior and prior to its discharge through the grate apertures, and that such air also serves to maintain the grate and the thereto-adjacent furnace components, including support members 40,42, at a lesser temperature than they would otherwise attain. Both the aforesaid pre-heating of the combustion air discharged from the grate apertures, and the cooling of the grate and adjacent components of the furnace, are desirable and beneficial features.

Figure 7:
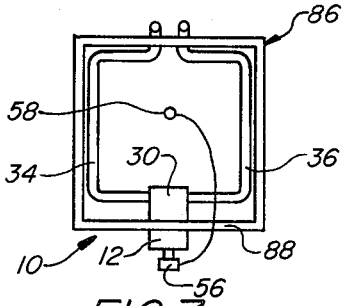
FIG. 7 is a diagrammatic top plan view showing the furnace installed in association with a tobacco barn or similar structure.

FIG. 7 of the drawings schematically illustrates how furnace 10 may be advantageously installed in association with and employed for the heating of a tobacco barn 86 or similar structure. Hopper-like member 12 of furnace 10 is disposed adjacent the exterior of one vertical wall 88 of barn 86, while manifold chamber 30 projects horizontally into barn 86 through a suitable opening (not shown) provided through the lower portion of wall 88. Suitable insulating material (not shown) should be provided between confronting surfaces of wall 88 and furnace 10 to shield the former from the heat of the latter. Continuations or extensions of the ducts 34, 36 communicating with manifold chamber 30 extend horizontally through the interior of barn 86, before exiting therefrom and discharging vertically upwardly. Heating of barn 86 is initiated by filling the upper section of hopper-like member 12 with sawdust or similar waste fuel, actuating blower 56 and initiating combustion of the fuel adjacent the upper surface of grate 38 by means of a starter fire or flame within that lower portion of member 12 that is readily accessible through ash removal opening 52 when its associated door 54 is opened. Following initial ignition thereof, combustion of the fuel adjacent the upper surface of grate 38 is vigorously maintained by the jets of air discharged upwardly from the grate, notwithstanding the then-closed conditions of both lid 26 and door 54 of hopper-like member 12. The angular disposition of the apertures 74 adjacent grate openings 64, together with the provision of rods 70 in association with such openings, minimize the amount of unburned fuel passing downwardly with the ash through openings 64, while the close proximity of the upper rear edge of the grate to the upper extremity of gas outlet 28 similarly discourages the escape of uburned fuel through such outlet. Further, and in any event, subsequent complete combustion of any unburned fuel particles thus escaping from the upper surface of grate 38 is assured by the additional jets of air discharged through grate apertures 76, 78, 82 and/or 84. At least by the time of their discharge from manifold chamber 38 through ducts 34,36, therefore, the combustion products introduced into chamber 30 through passageway 28 consist almost exclusively of heated gases. Both chamber 30 and ducts 34,36 are heated by the combustion gaes conducted therethrough, and radiate heat from their exterior surfaces into the interior of barn 86. The thermostat or other temperature-responsive switch 58 associated with blower 56 automatically de-actuates such blower when the temperature within barn 86 has reached a desired preset value, and subsequently re-actuates the blower when the barn temperature falls below such value, in a well known manner. During those periods of time when blower 56 is deactuated, sufficient air leaks past the door 54, cover plate 46 and/or lid 26 associated with hopper-like member 12 as to insure that the fuel adjacent the upper surface of grate 38 will continue to smolder and, upon re-actuation of the blower, will once again undergo vigorous combustion.

The exterior location of hopper-like member 12 permits a large supply of sawdust or similar waste fuel, which customarily is rather bulky and "messy" to handle, to be located outside of barn 86 and periodically introduced into the hopper without opening, and thus allowing escape of heat from, the barn. Due to considerable size of that portion of member 12 above grate 38, only infrequent replenishment of the fuel supply, at approximately six to eight hour intervals, is necessary. The sawdust or similar fuel need not be completely dry when introduced into hopper-like member 12 since the same is progressively heated and dried as it descends downwardly by gravity from hopper inlet 24 to grate 38. As previously noted herein, such gravity descent of the fuel within hopper-like member 12 reliably occurs due to the smooth-surfaced configuration and downwardly-increasing cross-sectional area of the interior of member 12.

As is indicated by phantom lines in FIGS. 2 and 3, manifold chamber 30 of furnace 10 may if desired be surrounded by an enclosure 100 that receives air through a duct 102 and, following heating of such air, discharges the same through another duct 104. Such arrangement may be employed in lieu of or in addition to that previously described for heating the interior of barn 86, or other desired structure, either by convection or by heat radiated from the exterior surfaces of ducts 102, 104. It will further be appreciated that, if desired, a fluid other than air might similarly be circulated through enclosure 100 and ducts 102, 104.

While a preferred embodiment of the invention has been specifically shown and described, this was for purposes of illustration only, and not for purposes of limitation, the scope of the invention being in accordance with the following claims.

I claim:

1. A furnace for efficiently burning sawdust and similar waste-type fuel, comprising:

an upstanding hopper-like member having a fuel inlet adjacent its upper end and a combustion gas passageway opening laterally from its lower end portion;

a generally horizontally extending and box-like hollow grate disposed within said hopper-like member at an elevation spaced closely beneath the uppermost extremity of said passageway, said grate having a hollow border section and a plurality of hollow coplanar spacially aligned medial sections, said medial sections communicating with said hollow border section, rod means, said rod means being coplanar with upper surface of said medial sections, said rod means being laterally centered between said medial sections and rigidly joined to said border section, said grate having a plurality of laterally spaced slot-like openings extending horizontally of and vertically through the medial portion thereof;

the interior of said hopper-like member being smooth surfaced and of gradually increasing cross-sectional area from said fuel inlet to said grate to facilitate gravity descent of said fuel within said member from said inlet to said grate;

a manifold chamber extending generally horizontally outwardly from said lower end portion of said hopper-like member and communicating therewith through said passageway of said member;

duct means communicating with said manifold chamber for conducting therefrom heated gaseous products of combustion introduced into said chamber from said passageway of said hopper-like member;

blower means disposed exteriorally of said hopper-like member and communicating with said grate for, when actuated, conducting air to the interior of said grate; said grate having first aperture means therein for discharging jets of air substantially vertically upwardly from said grate, and having second aperture means for discharging angularly upwardly jets of air from said grate, and having third aperture means for discharging jets of air substantially vertically downwardly from said grate, and having fourth aperture means for discharging jets of air angularly downwardly from said grate.

2. A furnace as in claim 1, wherein said second aperture means includes sets of apertures associated with one of said plurality of grate openings, the apertures of each of said sets being spaced along upper edges of the associated one of said grate openings and discharging jets of air angularly upwardly above said opening.

3. A furnace as in claim 2, wherein said second and said fourth aperture means each include apertures disposed closely adjacent said passageway of said hopper-like member and discharging draft inducing jets of air through said passageway.

4. A furnace as in claim 1, wherein said hopper-like member has a grate passageway opening laterally from said lower end portion thereof, and further including releasable mounting means releasably mounting said grate within said lower portion of said hopper-like member while permitting removal of said grate therefrom when desired; said mounting means including elongate support members affixed to opposite interior sides of said hopper-like member for receiving and supporting said grate upon introduction thereof into said lower end portion of said hopper-like member through said grate passageway, and cover plate means secured to and movable with said grate for closing said grate passageway when said grate is fully introduced into said lower portion members.

5. A furnace as in claim 4, wherein said mounting means further includes releasable fastener members releasably securing said cover plate means to said lower portion of said hopper-like member, and wherein said blower means is affixed to and movable with said grate.

6. A furnace as in claim 5, wherein said lower portion of said hopper-like member has an opening therein for removal of ash therefrom; and further including openable and closeable door means for normally closing said ash-removal opening.

7. A furnace as in claim 6, wherein said fuel inlet of said hopper-like member is at the upper end of said member; and further including an openable and closeable lid member for normally closing said inlet.

8. A furnace as in claim 7, and further including a vertical baffle member extending longitudinally and approximately centrally of said manifold chamber; and wherein said duct means includes a pair of duct members respectively communicating with said chamber on opposite sides of said baffle member.

9. A furnace as in claim 8, wherein said elongate hopper-like member has a pair of confronting solid side walls and has confronting solid front and rear walls; and wherein, in at least that portion of said hopper-like member between said fuel inlet and said grate, said walls are each inclined relative to the vertical, and including manifold chamber enclosure means, said enclosure means having duct means.

* * * * *